United States Patent [19]

Hay et al.

[11] Patent Number: 4,898,597

[45] Date of Patent: Feb. 6, 1990

[54] FRIT BONDED ABRASIVE WHEEL

[75] Inventors: John Hay, Shrewsbury; Carole J. Markhoff-Matheny, Leicester; Brian E. Swanson, Northboro, all of Mass.

[73] Assignee: Norton Company, Worcester, Mass.

[21] Appl. No.: 236,586

[22] Filed: Aug. 25, 1988

[51] Int. Cl.[4] ..... C09K 3/14

[52] U.S. Cl. ..... 51/298; 51/307; 51/309

[58] Field of Search ..... 51/298, 307, 309

[56] References Cited

U.S. PATENT DOCUMENTS

| | | | |
|---|---|---|---|
| 1,338,598 | 4/1920 | Thomas | 51/308 |
| 1,918,312 | 7/1933 | Wooddell | 51/298 |
| 4,314,827 | 2/1982 | Leitheiser et al. | 51/298 |
| 4,543,107 | 9/1985 | Rue | 51/309 |
| 4,623,364 | 11/1986 | Cottringer et al. | 51/309 |
| 4,741,743 | 5/1988 | Narayanan et al. | 51/309 |
| 4,744,802 | 5/1988 | Schwabel | 51/309 |

*Primary Examiner*—Paul Lieberman
*Assistant Examiner*—Willie J. Thompson
*Attorney, Agent, or Firm*—Arthur A. Loiselle, Jr.

[57] ABSTRACT

A grinding wheel is disclosed which is made up of sintered aluminous abrasive and a vitrified bond, the vitrified bond being a frit. A large portion of the sintered aluminous abrasive may be replaced by a non-sintered abrasive and the bond may include fillers and/or grinding aids.

9 Claims, No Drawings

FRIT BONDED ABRASIVE WHEEL

TECHNICAL FIELD

The invention relates to vitrified bonded grinding wheels and more specifically to grinding wheels bonded with a frit.

BACKGROUND AND INFORMATION DISCLOSURE STATEMENT

The following publications are representative of the most relevant prior art known to the Applicants at the time of filing of the application.

| UNITED STATES PATENTS | | |
|---|---|---|
| 1,338,598 | April 27, 1920 | C. W. Thomas |
| 1,918,312 | July 18, 1933 | C. E. Wooddell |
| 4,314,827 | February 9, 1982 | M. A. Leitheiser et al. |
| 4,543,107 | September 24, 1985 | C. V. Rue |
| 4,623,364 | November 18, 1986 | T. E. Cottringer et al. |
| 4,741,743 | May 3, 1988 | K. S. Narayanan |
| 4,744,802 | May 17, 1988 | M. G. Schwabel |

The most significant development in the abrasive industry in recent years is a new type of non-fused or sintered abrasive with properties different from those of other abrasives. The unique properties of this new abrasive are primarily the result of the microstructure of the abrasive which in turn is a result of the processing techniques used to manufacture the material. One abrasive of this type is disclosed in U.S. Pat. No. 4,623,364. The product is, basically, a sintered aluminous abrasive which is highly dense and has a hardness of at least 18 GPa made up of a plurality of microcrystals of alpha alumina which are generally equiaxed and have a crystal size of no greater than 0.4 microns. This ultra finely crystalline alumina is prepared by forming an aqueous sol from water, finely pulverized, i.e. microcrystalline hydrated alumina, and a mineral acid; the sol may also contain varying amounts of zirconia or spinel forming magnesia. To the sol is added an effective amount of submicron alpha alumina particles which will function as seeds or a nucleating agent when the sol is fired at elevated temperature. The sol is cast into sheets or extruded, dried, and granulated. The green granules are then fired at about 1400° C.

Another sintered aluminous abrasive is that taught by U.S. Pat. No. 4,314,827, the major difference being this method does not include the addition to the sol of sub micron alpha alumina seed material. Here too, however, the composition may include other materials such as zirconia, hafnia, or mixtures of the two, or a spinel formed from alumina and an oxide of cobalt, nickel, zinc, or magnesium. Abrasive grain made in this manner contains alpha alumina in the form of cells or sunburst shaped alpha alumina crystals having a diameter of 5–15 microns, is somewhat lower in density than the preceding abrasive, and has a density of only about 15 GPa.

U.S. Pat. No. 4,744,802 also describes a seeded sol gel sintered aluminous abrasive which is seeded by alpha ferric oxide or alpha alumina particles. The product is made by preparing a sol of alpha alumina monohydrated particles, gelling the sol, drying the gel to form a solid, and sintering the calcined gel.

There are, of course, other sintered abrasives that have been in commerce for years, such as abrasives based on sintered bauxite and sintered alumina-zirconia.

While sintered aluminous abrasives have properties that should make them outstanding abrasives, they do not live up to expectations in two significant areas. One area is in dry grinding with wheels wherein the abrasive is bonded with the more commonly used vitrified bonds, i.e. those that are fired and matured at temperatures of about 220° C. or above. As stated in U.S. Pat. No. 4,543,107, attempts to use sintered aluminous abrasive bonded with such vitrified bonds in dry grinding were not completely successful. This is completely contrary to what happens with abrasive products bonded with so-called resinoid or organic polymer bonds; these bonds mature at temperatures in the range of 160° C. to 225° C. The same is true when the sintered aluminous abrasives are used in coated abrasive products. Organic bonded grinding wheels are exemplified in U.S. Pat. No. 4,741,743. A seeded sol gel type abrasive as described in U.S. Pat. No. 4,623,364 is bonded with a phenol-formaldehyde type bond, in combination with a co-fused alumina-zirconia abrasive. The unique properties of the seeded sol gel sintered aluminous abrasive in combination with the cofused alumina-zirconia produce a synergistic effect and result in cut-off wheels with grinding qualities or ratios significantly superior to wheels containing the seeded sol gel sintered aluminous abrasive alone or the cofused alumina-zirconia alone. Under two sets of grinding conditions, the wheels containing sintered aluminous abrasive alone were superior to wheels containing the heretofore superior cofused alumina-zirconia abrasive; in one case the former was 100% better in G-Ratios that the latter.

The problem of extremely poor performance in dry grinding with sintered aluminous abrasive in the more commonly used vitrified bonds is addressed by U.S. Pat. No. 4,543,107. The inventor discovered that if the viscosity and/or maturing temperature of the bond is properly controlled, then the superior properties of sintered aluminous abrasive are brought out. This was accomplished by reducing the firing temperature (maturing temperature of the bond) to 1100 or less for conventional bonds or 1220° C. or less for the higher viscosity bonds.

While U.S. Pat. No. 4,543,107 has solved the problem of poor dry grinding properties associated with sintered aluminous abrasive bonded with the commonly used vitrified bonds, it has done nothing for the other significant area where the inherent goodness of sintered aluminous abrasives is not observed: that area is in the very important grinding operation called "wet grinding." In this type of operation, the workpiece and the grinding wheel are flooded with a coolant which can be essentially all water but may contain minor quantities of bactericide, antifoaming agents and the like, or, water containing 5–10% of a water soluble oil, or an all oil coolant; the instant invention and this discussion is concerned only with the water based coolants. It is well known that some decrease in grinding quality or G-Ratio is experienced in certain types of grinding, when a given vitrified bonded wheel goes from dry grinding to grinding with water. The drop is much more serious, however, in certain situations, being as large as 90% for vitrified bonded sintered aluminous abrasive wheels. Particularly in the case of wheels made with abrasive made according to the seeded sol gel technique referred to above, the reduction in G-ratio amounts to a loss of essentially all of the inherent superiority of that abrasive as compared to the conventional fused alumina which shows a drop of about 30% if the G-ratio for all infeeds are averaged.

As is also well known in the art, the use of a given vitrified bonded grinding wheel for wet grinding does not always produce results where there is a drop in grinding quality and other aspects of the grinding operation such as power consumption; the coolant in some wet grinding operations can actually cause the grinding quality to increase over that which results when dry grinding. In the case of sintered aluminous abrasives bonded with a conventional vitrified bond, the increase in grinding performance as a result of the coolant doesn't occur or is minimized. In other words, the exposure of the combination of commonly used vitrified bonds and sintered aluminous abrasives to water destroys a major part of the superior properties of that particular abrasive type. It is this very phenomenon with which the present invention is concerned.

Of relevance to the present invention are U.S. Pat. Nos. 1,338,598 and 1,918,312. They are relevant for their teaching of bonding abrasive grain with a frit to form a grinding wheel. The abrasive grain in both patents is the fused alumina type. Frits are well known materials and have been used for many years as enamels for coating, for example, metals and jewelry and for bonding abrasives as evidenced by the foregoing patents. Frit is a generic term for a material that is formed by thoroughly blending several minerals, oxides, and other inorganic compounds, followed by heating the mixture to a temperature at least high enough to melt it; the glass is then cooled and pulverized. There are almost an infinite number of possible frits in view of the numerous combinations of materials and amounts thereof. Some of the more common materials that are used to form frits are: feldspar, borax, quartz, soda ash, red lead, zinc oxide, whiting, antimony trioxide, titanium dioxide, sodium silicofluoride, flint, cryolite, and boric acid. Several of these materials are blended together as powders, fired to fuse the mixture, and the fused mixture is then cooled. The cooled glass is comminuted to a very fine state. It is this final powder that is used to bond abrasive grain to form a grinding wheel.

DISCLOSURE OF THE INVENTION

The present invention resides in the discovery that the known drastic drop in grinding quality which results when vitrified bonded sintered aluminous abrasive wheels are utilized with a water based coolant, can essentially be eliminated or drastically reduced by using a frit for the bonding medium, i.e. a vitreous bond composition that has been prefired prior to its employment as the bond.

The term frit as used herein means the product which results when the usual vitrified bond materials are prefired at temperatures of from 1100° C. to 1800° C. for as long as required to form a homogeneous glass. The temperature and time required to form the frit depends on its composition.

Some frits are relatively low melting so that when such a frit is used as a grinding wheel bond the green wheel is fired at a relatively low temperature, e.g. around 900° C., as compared to more conventional vitrified bonds which need to be fired at 1220° C. or higher. It has been found that high firing temperatures are seriously deleterious to the dry grinding properties of the vitrified bonded wheel. This particular problem has been solved by using low-fired vitrified bonds but this solution has no effect on the grinding quality of such wheels when used with a water based coolant (see U.S. Pat. No. 4,543,107). The present invention is a major advancement over the prior art because the relatively low firing temperature of the fritted bond preserves the superior dry grinding characteristics of sintered aluminous abrasives, and additionally extends those superior properties into wet grinding with a water based coolant. The importance of this development is readily appreciated when one realizes that a very substantial amount of grinding done with vitrified wheels is done with a water based coolant.

There are several so-called sintered aluminous abrasives currently known such as sintered bauxite, the seeded sol gel abrasive taught by U.S. Pat. No. 4,623,364 and sol gel abrasive such as described in U.S. Pat. No. 4,314,827. The seeded sol-gel process produces sintered aluminous abrasives of extremely fine crystallinity. That is particularly true of the seeded sol gel process of the former patent. The exact reason why the present invention results in grinding wheels with improved performance in wet grinding with sintered aluminous abrasives is not completely understood. However, it may be related to the absence in the frit bond of materials which give off chemically combined water or which melt at temperatures below the firing temperature of the abrasive and thus react with said abrasive. It is theorized that the increased surface reactivity of the sintered aluminous abrasives make them more susceptible to attack by (1) chemically combined water released from clays normally found in vitrified bonds when fired at 600° C. or higher, or, (2) chemically combined water from hydrated boron compounds, or, (3) molten $B_2O_3$ at 580° C. and higher.

While the invention has a most pronounced effect on vitrified bonded wheels wherein all the abrasive is the sintered aluminous type, it is also effective when the grinding wheel contains as little as 10% by weight of sintered aluminous abrasive and up to 90% by weight of a secondary abrasive of a different type. In other words, the present invention includes mixtures of 10% to 100% by weight of sintered aluminous abrasive and 0% to 90% of a secondary abrasive. In some grinding applications the addition of a secondary abrasive is for the purpose of reducing the cost of the grinding wheel by reducing the amount of premium priced sintered aluminous abrasive. In other applications a mixture of sintered aluminous abrasive and a secondary abrasive has a synergistic effect. However, in any case, if a significant amount of sintered aluminous abrasive is utilized in a vitrified wheel for wet grinding, the abrasive should be bonded with a frit in accordance with the present invention. Examples of such secondary abrasives include fused alumina, cofused aluminazirconia, silicon carbide, boron carbide, garnet, emery, flint, cubic boron nitride, diamond, or mixtures thereof.

In the simplest and preferred embodiment, the invention is the combination of sinteredaluinous abrasive, alone or admixed with a different abrasive, bonded entirely with a frit. However, relative to some grinding operation wheels with advantageous properties can result when the bond also contains other than only frit. The bond may be made up of a combination of at least 40% frit with the remainder being unfired clay or any combination of unfired vitrified bond ingredients. While fillers and grinding aids are more widely used in resinoid bonded grinding wheels, these materials can be incorporated in vitrified bonded wheels to advantage in some grinding applications. From 1% to 40% by weight of a filler or grinding aid such as mullite, kyanite, cryolite, nepheline syenite and like minerals, or mixtures when made part of the bond formulation may produce improved results.

The preferred sintered abrasives for use in the invention are the dense, finely microcrystalline alpha alumina abrasives produced by the seeded sol gel technique of U.S. Pat. No. 4,623,364 and the non-seeded sol gel technique of U.S. Pat. No. 4,314,827, the most preferred being the dense finely crystalline alpha alumina seed gel abrasive of the former patent. In addition to alumina, the abrasive of the former patent may optionally also include an effective amount of a grain growth inhibitor such as silica, chromia, magnesia, zirconia, hafnia, or mixtures thereof, although addition of such materials is not required; the abrasive of the latter patent in addition to alumina, must include (1) at least 10% of zirconia, hafnia, or a combination of zirconia and hafnia, or (2) at least 1% of a spinel derived from alumina and at least one oxide of a metal selected from cobalt, nickel, zinc, or magnesium, or (3) 1–45% of zirconia, hafnia, or the combination of zirconia and hafnia and at least 1% of spinel. In addition the present invention is applicable to a broad range of grinding grades, i.e. volume percentages of abrasive grain, bond, and pores. The wheels may be made up of 32% to 54% abrasive grarn, 2% to 20% bond, and 15% to 55% pores.

EXAMPLES OF THE PREFERRED EMBODIMENTS

Example I

A series of vitrified bonded wheels measuring 5 inches in diameter, 0.5 inch thick, and having a 1.25 inch hole were made by conventional mixing, cold molding and firing methods. Wheel A contained a commercial fused alumina abrasive bonded with a commercially available non-fritted vitrified bond. This wheel is commercially sold by Norton Company of Worcester, Mass. and designated as 32A54-J8VBE. The product was fired in a commercial firing cycle. Wheel B was another product available from Norton Company but this wheel contained a seeded sol gel sintered aluminous abrasive of the type disclosed in U.S. Pat. No. 4,623,364. The abrasive was bonded with a non-fritted vitrified bond and fired in another commercial firing cycle and designated as SG54-JVS. Wheel C was the invention wheel containing the same sintered aluminous abrasive as did wheel B but the bond was a fully or completely fritted vitrified bond composition purchased from the O. Hommel Company of Pittsburgh, Pa. The powdered frit had a particle size of −325 mesh U.S. Standard Sieve Series, and O. Hommel's designation for this frit was 3GF259A. On a weight percent basis, the frit was made up of 63% silica, 12% alumina, 1.2% calcium oxide, 6.3% sodium oxide, 7.5% potassium oxide and 10% boron oxide. The green wheel was fired at 900° C., to mature the bond, the firing cycle being a 25° C./hr. rise from room temperature to 900° C., a soak at 900° C. of 8 hours, and a free rate of cooling down to room temperature.

All three wheels contained 48% by volume of abrasive but whereas wheels A and B contained 7.2% by volume of non-fritted vitrified bond, the amount of bond in wheel C was increased to 9.1% by volume, which in turn resulted in a corresponding reduction in porosity. The reason for increasing the amount of bond in the invention wheel C was to make the hardness of wheel C about equal to the hardness of the wheels A and B. Fritted bonds tend to be softer acting, i.e. weaker, than conventional non-fritted bonds so that an equal amount of bond would have prejudiced the grinding results.

The mix for wheel C was prepared by adding to a Hobart mixer the following materials in the order and amounts indicated and thoroughly mixing.

| Material | Amount |
|---|---|
| Sintered aluminous abrasive according to U.S. Pat. No. 4,623,364 | 500 g 46 grit and 500 g 60 grit |
| Dextrin | 12 g |
| Glycerine | 1 g |
| Water | 28 g |
| O. Hommel frit | 119.7 g (−325 mesh) |
| Dextrin | 20 g |

A 373.4 g portion of the thusly prepared mix was placed in a cylindrical steel mold, including top and bottom plates and an arbor which when assembled formed a cavity 5.5 inches in diameter, 0.5 inch thick with a 1.25 inch hole. The wheel was pressed to size at room temperature and fired according to the firing cycle described above. After firing, all the wheels were sided down to 0.25 inch thickness and were. tested plunge grinding on a 4340 steel block 16 inches long using a water based coolant composed of 2.5% White and Bagley E55 coolant with the remainder being water. Plunges were 0.5 and 1 mil downfeed for a total of 100 mils. both wheelwear and material removed were used to calculate the grinding ratio, by dividing the total material removed by the total wheel wear; the power consumed was also determined in terms of horse power consumed per cubic inch of metal removed. The grinding results are contained an Table I.

TABLE I

| Wheel | Abrasive | Down Feed | G-Ratio | HP/in3 |
|---|---|---|---|---|
| A | Fused | 0.5 | 36.8 | 4.37 |
| | Alumina | 1.0 | 36.6 | 5.87 |
| B | Sintered | 0.5 | 117.2 | 4.36 |
| | Aluminous | 1.0 | 57.2 | 5.94 |
| C | Sintered | 0.5 | 347.8 | 3.21 |
| | Aluminous | 1.0 | 106.3 | 4.97 |

The effect on the grinding quality, i.e. G-Ratio, wet grinding with wheels containing the sintered aluminous abrasive shows the direct influence of substituting the frit of wheel C for the more conventional non-fritted bond of wheel B. The invention wheel C had a G-Ratio at 0.5 mil infeed about 300% greater than that of B, and at 1.0 mil infeed C was 186% better than B. When the invention wheel C was compared to wheel A which contained a standard fused alumina bonded with a non-fritted vitrified bond it can be readily seen how the frit of wheel C brought out the full superiority of the seeded sol gel sintered aluminous abrasive with the latter exhibiting grinding ratios 945% and 290% higher than wheel A at 0.5 and 1.0 mil downfeeds respectively. It should be noted that the invention wheel consumed 15–25% less power to remove a cubic inch metal as compared to wheel A.

Example II

A sintered aluminous abrasive of the type disclosed in U.S. Pat. No. 4,314,327 was bonded with a frit and tested plunge grinding 52100 steel. Wheels containing this abrasive were designated as D. A wheel designated as E of the same grade but containing the sintered aluminous abrasive of Example I was tested along side of wheel D. The wheels were made in the same manner as described in Example I except that wheels D and E were made from abrasive-bond mixes of the following composition, with the various materials being added to the mixer in the order indicated.

WHEEL D

| WHEEL D | |
|---|---|
| Material | Amount |
| Sintered aluminous abrasive according to U.S. Pat. No. 4,314,827 | 2,000 g 60 grit |
| Dextrin | 24 g |
| Glycerine | 2 g |
| Water | 72 g |
| O. Hommel frit | 314.4 g |
| Dextrin | 40 g |

WHEEL E

| WHEEL E | |
|---|---|
| Material | Amount |
| Sintered aluminous abrasive according to U.S. Pat. No. 4,623,364 | 2,000 g 60 grit |
| Dextrin | 24 g |
| Glycerine | 2 g |
| Water | 62 g |
| O. Hommel frit | 303 g |
| Dextrin | 30 g |

The thusly prepared mixes were molded into wheels measuring 5 inches in diameter, 0.625 inches in thickness, with a 0.875 inch hole. The wheels were fired in the same firing cycle as set out in Example I for Wheel C. The finished wheels had volume percent make-ups of 40% abrasive, 11.5% bond, and 48.5% pores. After finishing, the wheels were tested in cylindrical plunge O.D. grinding using several different constant forces with each wheel. The results are contained in Table II showing the G-Ratio and power of each force level and the average. The test was done in a water soluble oil coolant made up of 95% water and 5% Cincinnati Milacron Cimperial 20 oil, a wheel speed of 8650 surface feet per minute, a work speed of 150 feet per minute, and the wheels were trued with a single point diamond using a 0.001 inch diametral dress depth and a 0.005 inch/revolution lead.

TABLE II

| Wheel | Force lbs/in. | G-Ratio | Power hp/in. |
|---|---|---|---|
| D | 111 | 85.6 | 8.9 |
| | 171 | 103.3 | 14.1 |
| | 217 | 82.2 | 17.9 |
| | 166 ave. | 90.2 ave. | 13.6 ave. |
| E | 97 | 92.4 | 8.3 |
| | 151 | 81.7 | 12.4 |
| | 67 | 108.8 | 5.8 |
| | 196 | 70.3 | 15.6 |
| | 128 ave. | 88.3 ave. | 10.5 ave. |

Example I shows the drastic improvement in grinding properties affected by bonding that particular sintered aluminous abrasive with a frit. The data in Table II shows the same effect on a second type of sintered aluminous abrasive when bonded with a frit, the data comparing wheel D with frit bonded sintered aluminous abrasive according to U.S. Pat. No. 4,314,327, as well as wheel E With frit bonded sintered aluminous abrasive of U.S. Pat. No. 4,623,364.

EXAMPLE III

The bond of the present invention does not need to be composed entirely of frit. In some cases it may be advantageous to reduce the amount of frit and add a quantity of unfritted bonding material. This appears to be the case plunge grinding 52100 steel according to the data in Table III below. Three wheels were made utilizing the sintered aluminous abrasive of U.S. Pat. No. 4,623,364. All of the wheels contained 48% by volume of abrasive. The wheel designated as F was bonded with a conventional commercial vitrified bond designated as bond VS used by Norton Company of Worcester, Mass. In wheel G the abrasive was bonded with the same frit that was used in wheel C of Example I and wheels D and E of Example II; the entire bond was frit. The bond in wheel H, on the other hand, was made up of 71% by weight of frit and 29% by weight of Kentucky ball clay. The frit was a frit prepared by the Ferro Corporation of Cleveland, Ohio. Because fritted bonds are inherently softer acting in grinding than non-fritted bonds, as pointed out above, the fired volume percent content of wheel F was adjusted downward by reformulating the bond composition prior to firing. Thus on a fired volume percent basis, wheel F was 48% abrasive, 9.1% bond, and 42.9% pores; wheels G and H were 48% abrasive, 11.5% bond, and 40.5% pores. This produced wheels of the same hardness.

Wheels of the same size as in Example II were made in the same manner as in Example I from mixes having the following compositions, with the various materials being added to the mixer in the order they are listed.

WHEEL G

| WHEEL G | |
|---|---|
| Material | Amount |
| Sintered aluminous abrasive according to U.S. Pat. No. 4,623,364 | 2000 g 80 grit |
| Dextrin | 24 g |
| Glycerin | 2 g |
| Water | 60 g |
| O. Hommel frit | 303 g |
| Dextrin | 30 g |

WHEEL H

| WHEEL H | |
|---|---|
| Material | Amount |
| Sintered aluminous abrasive according to U.S. Pat. No. 4,623,364 | 2000 g 80 grit |
| Dextrin | 24 g |
| Glycerin | 2 g |
| Water | 40 g |
| 209.2 g Ferro frit and 85.2 g clay prebatched | 294.4 g |
| Dextrin | 16 g |

The green wheels G and H were fired at 900° C. to mature the bond; the green wheel F because it contained the prior art commercial bond, was fired in a commercial firing cycle. The finished wheels were then subjected to a grinding test identical to that described in Example II with the following results.

TABLE III

| Wheel | Force lb/in | G-Ratio | Power hp/in |
|---|---|---|---|
| F | 80 | 116.1 | 7 |
| | 171 | 75.9 | 15.3 |
| | 196 | 53.8 | 17 |
| | 149 ave. | 81.9 ave. | 13.1 ave. |
| G | 79 | 191.9 | 7.3 |
| | 166 | 132.8 | 15.5 |
| | 186 | 31.6 | 16 |
| | 158 | 70.6 | 15.8 |
| | 146 | 132.7 | 13.5 |
| | 147 ave. | 111.8 ave. | 13.6 ave. |
| H | 96 | 162.3 | 9.2 |
| | 150 | 171.6 | 14.1 |
| | 65 | 187.5 | 6.1 |
| | 197 | 109.6 | 17.5 |
| | 127 ave. | 157.8 ave. | 11.7 ave. |

Wheel H which contained only 71% frit had even a higher grinding quality i.e. G-Ratio, in this particular grinding operation, than did wheel G, the all frit bonded wheel. Both wheels were superior to wheel F which was bonded with a standard non-fritted bond.

Example IV

The vast improvement in wet grinding with frit bonded sintered aluminous grinding wheels as compared to wheels bonded with the more conventional vitrified bonds continues to manifest itself even when the sintered aluminous abrasive is mixed with a second abrasive which is not a sintered aluminous abrasive.

Vitrified bonded wheels measuring 5 inches in diameter and 0.625 inches thick with a 0.875 inch hole were manufactured in the conventional manner. One set of wheels, designated as I was bonded with 0. Hommel frit 3GF259A and fired at 900° C. to mature the bond; the other set of wheels identified as J was bonded with a commercial bond used by Norton Company of Worcester, Mass. designated as HA4 and these wheels were also fired at 900° C. The wheels were straight rim type wheels widely used for many grinding operations where the abrasive is diamond or cubic boron nitride CBN. The rim or grinding section of the wheels were made from the following mix composition and resulted in the indicated finished volume percent composition.

| Material | Wheel I Finished Vol. % | Wheel I Mix Formula | Wheel J Finished Vol. % | Wheel J Mix Formula |
|---|---|---|---|---|
| CBN | 9 | 8.2 g (140/170 grit) | 9 | 8.19 (140/170 grit) |
| Sintered aluminous Abr.(U.S. Pat. No. 4,623,364) | 39 | 39.6 g (150 grit) | 39 | 39.96 g |
| O. Hommel frit | 27 | 16.9 g | | |
| HA4 bond | | | 14.61 | 10.56 g |
| DWC | | 5.5 g | | |
| Dextrin | | | | 0.21 g |
| Aeromer 30 | | | | 2.08 g |
| Pores | 25 | | 37.39 | |

The core of the wheels has the following mix composition and finished volume percent composition.

| Material | Wheel I Finished Vol. % | Wheel I Mix Formula | Wheel J Finished Vol. % | Wheel J Mix Formula |
|---|---|---|---|---|
| 38A150* | 44.8 | 342.78 g | 39 | 298.97 g |
| 37C150** | | | 9 | 56.32 g |
| O. Hommel frit | 25.2 | 118.05 g | | |
| HA4 bond | | | 14.61 | 79.00 g |
| DWC*** | | 32.26 g | | |
| Dextrin | | | | 1.56 g |
| Aeromer 30 | | | | 15.31 g |
| Pores | 30 | | 37.39 | |

*150 grit 38 ALUNDUM sold by Norton Co., Worcester, MA.
**150 grit silicon carbide sold by Norton Co., Worcester, MA.
***2.28% methyl cellulose, 9.78% glycerine, and 87.94% water by weight.

The finished wheels were tested grinding 52100 steel using a coolant made up of water and a water soluble oil at 10:1 water to oil. The results were as follows:

TABLE IV

| Wheel | Force lb/in. | G-Ratio | Power hp/in. |
|---|---|---|---|
| I | 99.5 | 644.1 | 9.9 |
| | 159 | 412.2 | 15.7 |
| J | 106 | 350.7 | 10.6 |
| | 176 | 211.0 | 16.0 |

Even when about 20% of the sintered aluminous abrasive is removed from the wheel and CBN put in its place, the effect of the frit bond is dramatic. At a force of about 100 lb/in the fritted bond wheel I had a G-Ratio 84% higher than that of wheel J containing the commercial bond HA4, and at 159 and 176 lb/in. the G-Ratio of wheel I was 95% higher than that of wheel J.

What is claimed is:

1. A grinding wheel comprised of abrasive grain and a vitrified bond therefor, said abrasive grain consisting essentially of from 10% to 100% by weight of a polycrystalline sintered aluminous abrasive and from 0% to 90% by weight of a second type of abrasive, and wherein said vitrified bond contains at least 40% by weight of frit.

2. The grinding wheel of claim 1 wherein said second type of abrasive is one selected from the group consisting of fused alumina, cofused alumina-zirconia, silicon carbide, boron carbide, garnet, emery, flint, cubic boron nitride, diamond, and mixtures thereof.

3. The grinding wheel of claim 1 wherein said abrasive grains are present in an amount by volume of 32% to 54%, said bond is present in an amount by volume of 2% to 20% and wherein said grinding wheel includes from 15% to 55% by volume of pores.

4. The grinding wheel of claim 1 wherein said vitrified bond contains from 1% to 40% by weight of a filler selected from the group consisting of mullite, kyanite, cryolite, nepheline syenitel and mixtures thereof.

5. The grinding wheel of claim 2 wherein said second type of abrasive is fused alumina.

6. The grinding wheel of claim 2 wherein said second type of abrasive is cubic boron nitride.

7. A grinding wheel comprising abrasive grain and a vitrified bond therefor, said abrasive grain being and a vitrified bond made up of from 10% to 100% by weight of a seeded sol gel sintered aluminous abrasive and from 0% to 90% by weight of a second type of abrasive, said vitrified bond containing least 40% by weight of frit, and wherein each sintered seeded sol gel aluminous abrasive grain consists essentially of a plurality of microcrystals of alpha alumina which are generally equiaxed and have a size no greater than about0.4 microns.

8. The grinding wheel of claim 7 wherein said sintered aluminous abrasive includes an effective amount of a grain growth inhibitor selected from the group consisting of silica, chromia, magnesia, zirconia, hafnia, and mixtures thereof.

9. A grinding wheel comprising abrasive grain and a vitrified bond therefor, said abrasive grain being made up of from 10% to 100% by weight of a sintered aluminous abrasive and from 0% to 90% by weight of a second type of abrasive, said vitrified bond containing at least 40% by weight of frit, and wherein the sintered aluminous abrasive is substantially calcium ion and alkali metal ion free and has a substantially homogeneous microcrystalline structure comprising a secondary phase of crystallites comprising a modifying component in a dominant continuous alumina phase comprising alpha alumina, said modifying component, on a volume percent of fired solids of said sintered aluminous abrasive, being selected from:

(i) at least 10% of zirconia, hafnia, or a combination of zirconia and hafnia, (ii) at least 1% of a spinel derived from alumina and at least one oxide of a metal selected from cobalt, nickel, zinc, or magnesium, or (iii) 1–4% of said zirconia, hafnia, or the combination of zirconia and hafnia and at least 1% of said spinel.

* * * * *